United States Patent [19]

Rasner

[11] 4,281,441

[45] Aug. 4, 1981

[54] JEWELRY CLASP

[76] Inventor: James W. Rasner, 8545 Mission Gorge Rd., Santee, Calif. 92071

[21] Appl. No.: 73,959

[22] Filed: Sep. 10, 1979

[51] Int. Cl.[3] ..... A44B 11/00; A44B 19/00

[52] U.S. Cl. ..... 24/230 R; 24/201 HE; 24/230 TC

[58] Field of Search ..... 24/230 R, 230 TC, 201 HE, 24/201 R, 224, 226, 243 R

[56] References Cited

U.S. PATENT DOCUMENTS

| | | | |
|---|---|---|---|
| 3,897,611 | 8/1975 | Booth et al. | 24/230 R |
| 3,967,351 | 7/1976 | Rosenberg et al. | 24/230 R |

FOREIGN PATENT DOCUMENTS

| | | | |
|---|---|---|---|
| 213813 | 5/1957 | Australia | 24/230 R |
| 184361 | 2/1965 | Fed. Rep. of Germany | 24/230 R |

*Primary Examiner*—Alexander Grosz
*Attorney, Agent, or Firm*—Henri J. A. Charmasson

[57] ABSTRACT

A clasp suitable for fastening necklaces, bracelets and other types of jewelry made of two interlocking elements. The first element is an oblong enclosure having one of the long ends permanently attached to the piece of jewelry. The opposite end has a restricted opening for receiving the second element. The second element is a flat elongated member permanently fastened at one end to the piece of jewelry and having a opening therethrough near the opposite end. A small projection extending at a slanted angle from the floor of the enclosure toward the back end, engages said aperture when the second element is inserted through said restricted opening.

6 Claims, 4 Drawing Figures

JEWELRY CLASP

BACKGROUND OF THE INVENTION

This invention relates to detachable fasteners and more particularly to clasps used in jewelry pieces such as necklaces and bracelets.

The most widely used type of clasp for jewelry is the so-called "spring-ring" which is constituted by an openable ring made of two telescopic circular sections. The loop is resiliently kept closed by a coil spring coaxially mounted inside one of the circular sections. The operation of this clasp, as well as other types of commonly used clasps, requires a certain amount of dexterity. The thumbnail must be used to open the loop, a procedure extremely difficult for a female with long fingernails. The step of engaging the loop into an even smaller ring at the other end of the piece of jewelry requires not only good eyesight but also very steady hands, far beyond the abilities elderly persons. The main drawback of these types of clasps is that they require a two-hand operation which makes them extremely unpractical for bracelets.

The so-called "box clasp" was developed to aleviate some of the shortcomings of these earlier types of clasps. This latter design relies upon the spring action of one of the two end elements which is a strip of metal bent midway into a V shape then inserted into the box-like second element. The major drawback of this design is that the spring element quickly loses its resilience. Consequently, the "box clasp" cannot be relied upon to secure valuable jewelry pieces.

SUMMARY OF THE INVENTION

The principal purpose of this invention is to provide a jewelry clasp which is easy to operate yet constitutes a reliable fastener for valuable pieces. Another object of this invention is to provide a jewelry clasp which can be operated single-handedly. Yet another object of this invention is to provide a jewelry clasp which can be manufactured by simple stamping, drilling or punching operations. It is also within the purpose of this invention to provide a jewelry clasp which lends itself to a variety of ornamental configurations which can enhance the appeal of the piece it secures. These and other objects of this invention are achieved by providing a clasp made of two interlocking elements. One element defines an oblong enclosure having a restricted opening in which the second element constituted of a flat strip is inserted and secured therein by a non-moving structure.

DESCRIPTION OF THE PREFERRED EMBODIMENT

Figure 1:
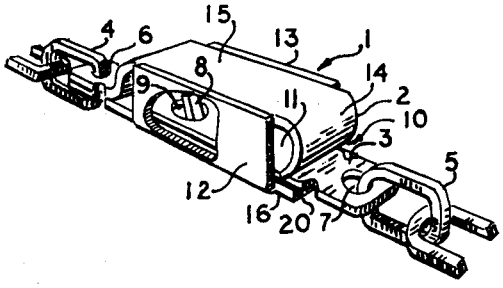
FIG. 1 is a perspective view of the preferred embodiment of the invention with part of the side cut away exposing the locking mechanism.

Referring now to the drawing and according to this invention there is shown a clasp 1 tying together the two end links 4 and 5 of a necklace chain or the like. The clasp 1 is made of two interlocking elements 2 and

3. Element 2 is permanently attached to the end link 4 of the necklace chain and defines a rectangular oblong enclosure delineated by a flat floor 16, sidewalls 12 and 13, roof 15, backwall 18 and front wall 14. A slot-like aperture 10 at the base of the front wall 14 allows for the introduction of the tongue-shaped second element 3 into the enclosure 11. A stub 8 is punched out of the floor 16 and extends into the enclosure 11 in a direction slanted toward the backwall 18. The second element 3 is permanently attached to the end link 5 of the necklace chain which is captured in hole 7. The opposite end of element 3 has a second hole 9 designed to engage over the stub 8 within the enclosure 11. It should be noted that the sidewalls 12 and 13 raise vertically from the floor 16 but are not connected to the roof 15 of the enclosure 11. Accordingly, the roof 15 and front wall 14 are allowed to resiliently move up and down, thus enlarging or restricting the slot apertre 10. In the absence of the second element 3 the slot-like aperture 10 is practically closed. The aperture 10 is forced open when the front end of the second element 3 is pushed against the curved lower part of the front wall 14. As the second element 3 is pushed forward into the enclosure 11, its front end slides upward against the ramp constituted by the stub 18, over the stub itself and snaps down into the lock position when the stub 8 engages the hole 9. Due to the fact that the floor 16 extends forward at 20 beyond the vertical plane of the aperture 10, a lever-effect is created and the downward pressure applied by the front wall 14 to the top surface of the second element 3 keeps the latter in the locked position. The clasp 1 can be disengaged by first pushing inward and tilting the second element 3 until the stub 8 disengages from the hole 9, then pulling the two elements 2 and 3 apart.

Figure 2:
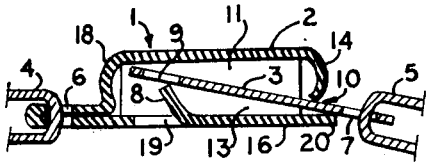
FIG. 2 is a longitudinal cross sectional view of the embodiment illustrating the clasping movement.
Figure 3:
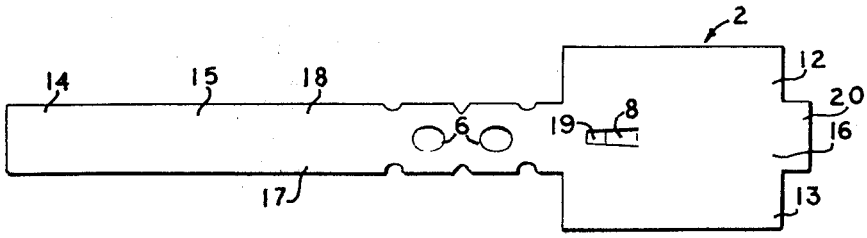
FIG. 3 is a bottom plan view of the first component in the last manufacturing state just before being folded into the final shape.
Figure 4:
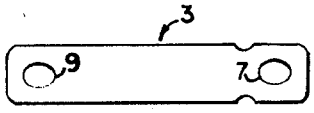
FIG. 4 is a top plan view of the second component.

The clasp 1 is remarkable in that it can be manufactured from inexpensive material such as plastic or steel, or from precious metals. A strip of material is stamped or punched to the configuration illustrated in FIG. 3. It should be noticed that the stub 8 is punched out of the floor area 16 leaving a small hole 19 in the base of the first element. The piece is then folded in the shape illustrated in FIG. 2. The second element can be manufactured in one single stamping or punching process as can be seen from FIG. 4. Ornamental designs can be applied to the roof 15 and the walls 12 and 14 which could also be encrusted with precious or semi-precious gems. The width and height of the clasp 1 can be varied freely in order to accommodate different types of jewelry pieces such as bracelets and wristwatches which may require a wider clasp than the one illustrated as the preferred embodiment of this invention.

While I have described the preferred embodiment of the invention and suggested modifications thereon, other embodiments may be designed and other modifications made thereto without departing from the spirit of the invention and from the scope of the appended claims.

What is claimed is:

1. A clasp for joining together first and second parts of a piece of jewelry or the like which comprises:

a first embodiment attached to said first part having a slot-like aperture and an anchoring means behind said aperture;

a second flat element attached to said second part, said second element insertable into said slot and having means for engaging said anchoring means;

said first element further comprises an oblong enclosure having:

a generally flat floor;

sidewalls extending upward from said floor;

a generally horizontal roof;

front and back walls extending downward from the roof;

the back wall being secured at its base to the floor;

the front wall being dimensioned to leave a slot-like aperture between its bottom edge and the floor;

said roof and front wall are free to resiliently move up and down, thereby enlarging or narrowing the aperture;

said anchoring means comprises:

a stub extending from the floor within the enclosure; and said second flat element having a hole engageable around the stub.

2. The clasp claimed in claim 1 wherein the stub is slanted from the floor toward the back wall.

3. The clasp claimed in claim 1 wherein the floor extends forward beyond the aperture; and the front wall is dimensioned and positioned to exert a downward pressure upon the second element inserted through the aperture.

4. The clasp claimed in claim 3 wherein said first element is made from a continuous strip of material bent into a shape consecutively and contiguously defining the horizontal floor;

extending backward beyond the floor, a first generally horizontal hollowed section;

a second horizontal hollowed section folded back over said first hollowed section, said hollowed sections forming a loop interlocking with said first part;

a back wall;

the roof; and the front wall.

5. The clasp claimed in claim 4 wherein said strip comprises a lateral projection on each side of the floor bent upward to form a sidewall.

6. The clasp claimed in claim 3 wherein the lower section of the first front wall is bent inwardly.

* * * * *